US006163927A

United States Patent [19]

Leu

[11] Patent Number: 6,163,927

[45] Date of Patent: Dec. 26, 2000

[54] DEVICE FOR COUPLING A COVER WITH A SCANNER BODY

[75] Inventor: William Leu, Taipei, Taiwan

[73] Assignee: Acer Peripherals, Inc., Taiwan

[21] Appl. No.: 09/078,600

[22] Filed: May 14, 1998

[30] Foreign Application Priority Data

Sep. 25, 1997 [TW] Taiwan ..... 86216360

[51] Int. Cl.[7] ..... E05D 7/12

[52] U.S. Cl. ..... 16/272; 16/266

[58] Field of Search ..... 16/235, 242, 246, 16/260, 268, 266, 271; 399/380; 355/75

[56] References Cited

U.S. PATENT DOCUMENTS

| | | | |
|---|---|---|---|
| 4,449,811 | 5/1984 | Betron et al. | 355/3 SH |
| 5,265,310 | 11/1993 | Ichinokawa | 16/266 |
| 5,365,309 | 11/1994 | Lawson | 355/75 X |
| 5,748,292 | 5/1998 | Kawasaki et al. | 355/75 |
| 5,812,285 | 9/1998 | Lin et al. | 358/497 X |
| 5,815,886 | 10/1998 | Nishio et al. | 16/360 X |

FOREIGN PATENT DOCUMENTS

| | | | |
|---|---|---|---|
| 3323480A1 | 1/1985 | Germany | 16/235 |

*Primary Examiner*—Lynne H. Browne
*Assistant Examiner*—John R. Cottingham
*Attorney, Agent, or Firm*—Pillsbury Madison & Sutro LLP

[57] ABSTRACT

A coupling device for coupling a cover to a platform body of a scanner. The coupling device comprises two legs for attaching to the cover; a pivot shaft formed between the distal ends of the two legal a stopper coupled to the pivot shaft at a first predetermined angle; a pivot socket formed at the intersection top surface of the platform and the platform sidewall comprising a cavity, two vertical slots formed in the sidewall of the platform and extending to and penetrating the top surface of the platform for respectively receiving the two legs into the cavity, a horizontal slot formed in the sidewall of the platform for receiving the pivot shaft into the cavity, an upper engaging portion, and a lower engaging portion. When the legs and pivot shaft are received into the cavity, the upper engaging portion, by contact with the pivot shaft, prevents the legs from escaping the cavity during vertical movement of the legs, and the lower engaging portion, by contact with the stopper, prevents the opening of the cover beyond a second predetermined angle. Furthermore, the height of the horizontal gap is slightly larger than the diameter of the pivot shaft, and smaller than the combined length of the diameter of the pivot shaft and the stopper when the legs are in a vertical attitude, such that the pivot shaft and stopper cannot slip out of the horizontal gap during vertical movement of the legs.

18 Claims, 6 Drawing Sheets

DEVICE FOR COUPLING A COVER WITH A SCANNER BODY

BACKAGROUND OF THE INVENTION

1. Field of the Invention

The present invention relates to a device for coupling a cover with a scanner body. More particularly, the present invention relates to a coupling device capable of coupling a cover with a scanner body in such a manner that the cover is not readily disengaged from the scanner body when scanning a thick document with the cover hooding thereon and the cover can be held at an inclined angle with respect to the scanner body without slumping.

2. Description of the Related Art

FIG. 1 is an exploded perspective view showing a cover 1' is detached from a scanner body 2' that is disclosed in Taiwan Utility Model Publication No. 297576. FIG. 2 is a crossed sectional view along the line II—II of FIG. 1, depicting a document undergoing scanning. As shown in FIG. 1 and FIG. 2, two coupling members 4' with two protrusions 5' formed at their lower ends are provided at one rim portion of the cover 1'. Furthermore, two cavities 6' used for accommodating the coupling members 4' and the protrusions 5' are formed within the corresponding rim of the scanner body 2', and slots 60' allowing the protrusions 5' and the coupling members 4' to penetrate and to sway therethrough are also formed on the surface of the corresponding rim of the scanner body 2'. As shown in FIG. 2, a document 8' to be scanned is placed on the top surface 20' of the scanner body 2' and hooded by the cover 1'. Due to the existence of the document 8', the cover 1' is elevated from the top surface 20' of the scanner body 2'. However, in the event that the thickness of the document 8' exceeds a certain extent, the coupling members 4' will be urged to escape from the slots 60' , and the cover 1' is thus disengaged from the scanner body and is unable to function as a cover of the scanner body.

SUMMARY OF THE INVENTION

It is therefore an object of this invention to provide a device for coupling a cover with a scanner body, which is capable of positively coupling a cover with a scanner body.

The other object of this invention is to provide a device for coupling a cover with a scanner body, which is capable of holding the cover at an inclined angle without slumping.

According to this invention, in the coupling device for coupling a cover with a scanner body, the cover is planar and has a coupling verge, the scanner body has a top surface for the placement of documents to be scanned and a side wall for the installation of the coupling device. The coupling device includes one pair of parallel legs integrally formed at the coupling verge of the cover and extending in the direction substantially normal to the cover; a stopper integrally formed with the distal ends of the parallel legs; and a pivot socket integrally formed at the intersecting corner of the top surface and the side wall of the scanner body, a cavity being formed within the pivot socket, a through slot, for the legs and the stopper penetrating therethrough, being formed in the side wall of the scanner body and the ends of the through slot being extending to the top surface of the scanner body so as to allow the distal ends of the parallel legs to enter the cavity by penetrating therethrough and to perform pivotal movement therewithin, and an engaging portion being formed on the inner wall of the cavity so as to engage with the stopper when the cover is swiveled around the pivot socket for a preset angle, whereby the cover and the scanner body are coupled by inserting the distal ends of the parallel legs into the cavity through the through slot of the pivot socket.

Furthermore, in the coupling device for coupling a cover with a scanner body, the stopper is extending from the distal ends of the legs at a predetermined angle with respect to the longitudinal axes of the legs so as to allow the cover to be swiveled from a horizontal position to a retained position through an angle larger than 90 degrees.

Furthermore, in the coupling device for coupling a cover with a scanner body, the engaging portion of the pivot socket is a through slot having an engaging surface formed at its end for engaging the stopper when the cover is swiveled to its retained position.

Furthermore, according to this invention, the coupling device for coupling a cover with a scanner body further includes one pair of parallel legs integrally formed at the coupling verge of the cover and extending in the direction substantially normal to the cover; a stopper integrally formed with the distal ends of the parallel legs; and a pivot socket integrally formed at the intersecting corner of the top surface and the side wall of the scanner body, a cavity being formed within the pivot socket, a through slot, for the legs and the stopper penetrating therethrough, being formed in the side wall of the scanner body and the ends of the through slot being extending to the top surface of the scanner body so as to allow the distal ends of the parallel legs to enter the cavity by penetrating therethrough and to perform pivotal movement therewithin, and an engaging portion being formed on the inner wall of the cavity so as to engage with the stopper when the cover is swiveled around the pivot socket for a preset angle, whereby the cover and the scanner body are pivotally coupled by two sets of the legs, stoppers, and pivot sockets.

BRIEF DESCRIPTION OF THE DRAWINGS

Other objects, features and advantages of the present invention will become apparent by way of the following detailed description of the preferred but non-limiting embodiment. The description is made with reference to the accompanying drawings, wherein.

DETAILED DESCRIPTION OF THE PREFERRED EMBODIMENTS

Figure 1:
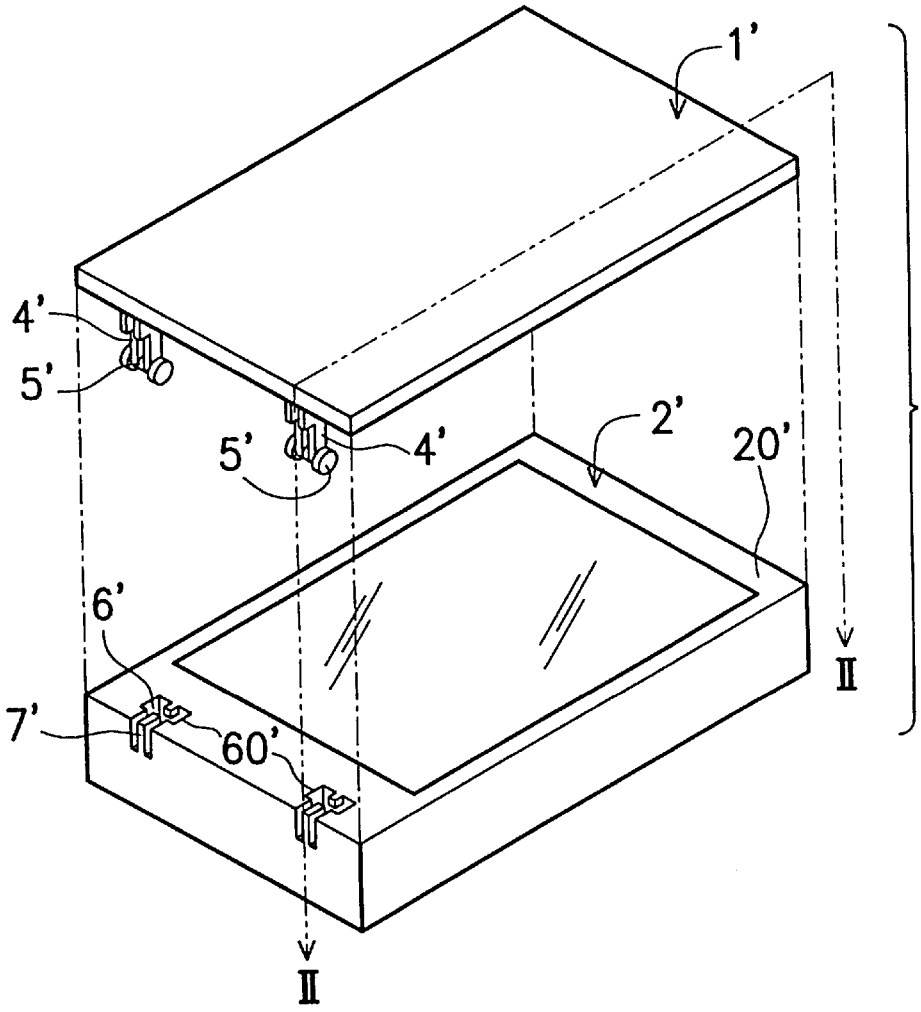
FIG. 1 (PRIOR ART)
FIG. 1 is an exploded perspective view showing a cover detached from a scanner body disclosed in Taiwan Utility Model Publication No. 297576.
Figure 2:
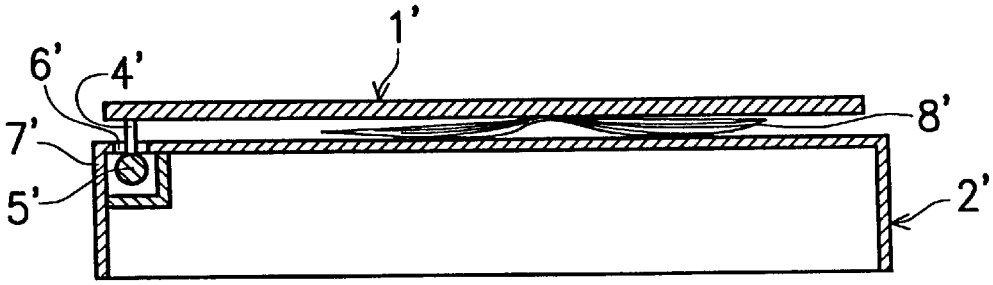
FIG. 2 (PRIOR ART)
FIG. 2 is a cross-sectional view along the line II—II is of FIG. 1, showing that a document is under scanning.
Figure 3:
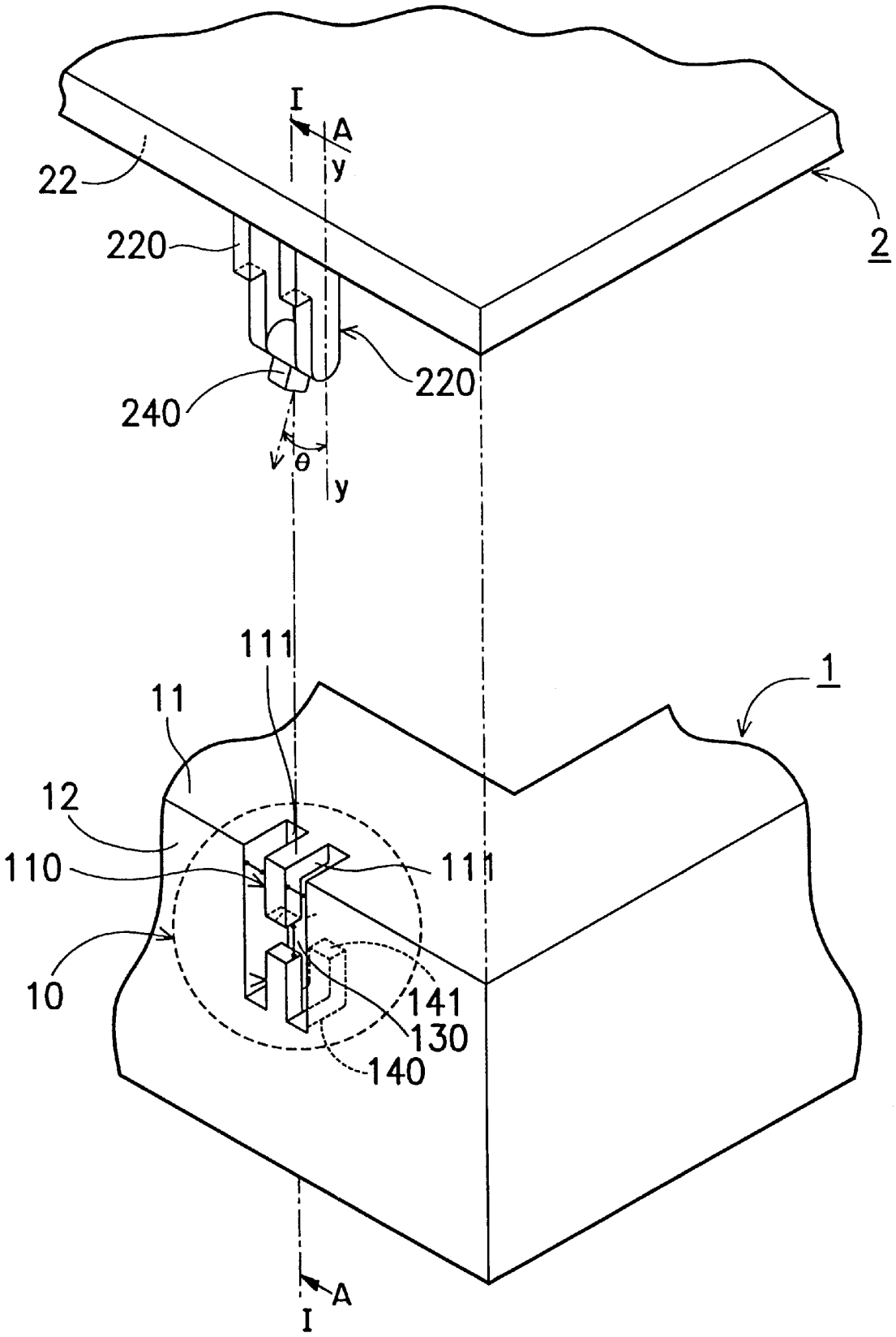
FIG. 3 is an exploded perspective view partially showing the structure of the coupling device applied to a cover and a body of a scanner according to this invention.

FIG. 3 is an exploded perspective view partially showing the structure of the coupling device applied on the according to this invention. As shown in FIG. 3, one pair of parallel legs 220 is integrally formed at the coupling verge 22 of a cover 2. The legs 220 are extending along a line 4—4 with the direction substantially normal to the cover 2. A stopper 240 is integrally formed with the distal ends of the parallel legs 220. The stopper 240 is extending from the distal ends of the legs 220 at an angle θ with respect to the longitudinal axes of the legs 220, i.e. along the line 4—4. A pivot socket 10 is integrally formed at the intersecting corner of the top surface 11 and the side wall 12 of the scanner body 1. A cavity 130 is formed within the pivot socket 10, and a slot 110 is formed in the side wall 12 of the scanner body 1. The upper ends 111 of the slot 110 extend to the top surface 11 of the scanner body 1. A section line I—I is passed through the stopper 240 of the cover 2 parallel with the line y—y as well as the cavity 140 of the body 1. An arrow A with a direction is normal to the line I—I and points from one leg 220 to another leg 220.

Figure 4A:
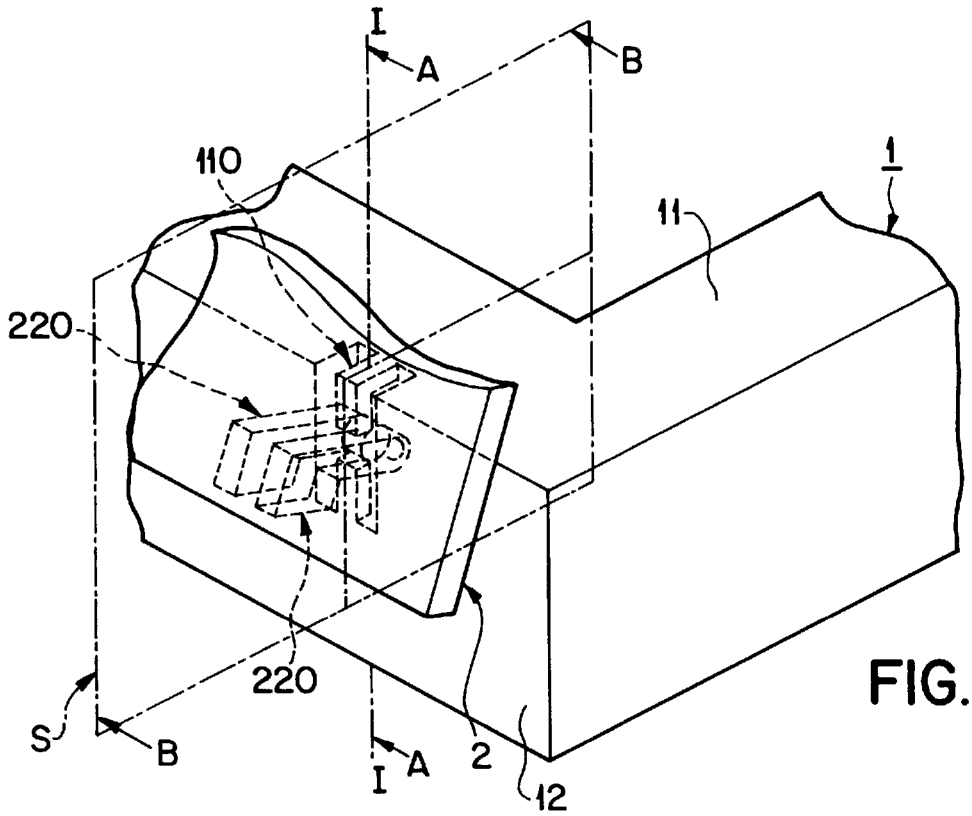
FIG. 4A is a partially perspective view of showing the connection between the cover and the body with the coupling device according to FIG. 3.
Figure 4B:
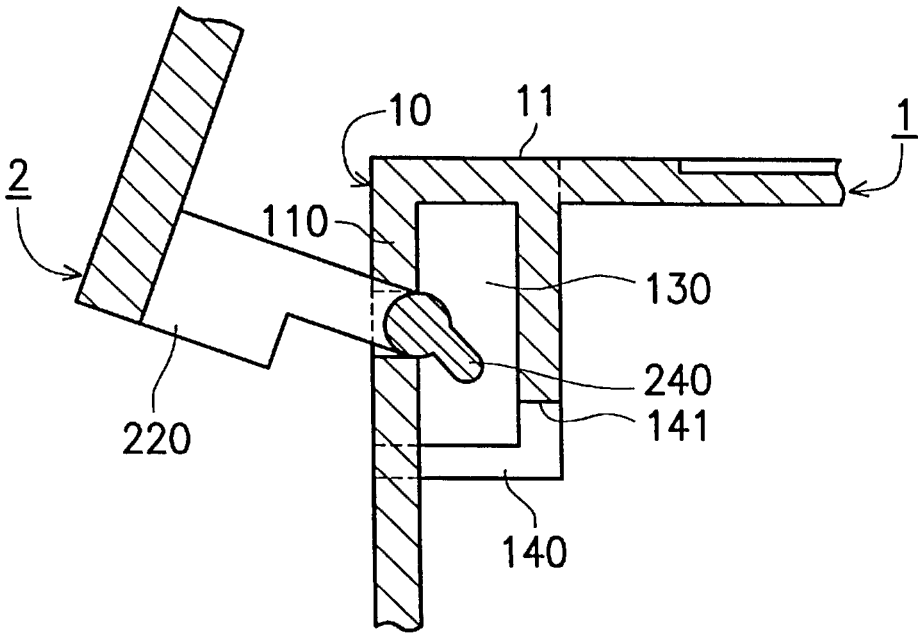
FIG. 4B is a partially cross-sectional view with the plan S inspected along the direction of the normal arrow B of FIG. 4A.

Referring to FIG. 4A and FIG. 4B, FIG. 4A is perspective view showing the connection between the cover 2 and the body 1 with the coupling device according to FIG. 3, and FIG. 4B is a cross-sectional view along a plane S with an arrow B of FIG. 4A.

The plane S, overlapped with the line I—I, is a presumptive plane perpendicular to the top surface 11 and partially intersected with the body 1 and the cover 2, wherein the plan S is passed through the slot 140 and the cavity 130. The arrow B, in parallel with the arrow A, is normal vector point to the plane S, and therefore the connection between the cover 2 and the body 1 and the inner structure of cavity 130 can be clearly seen with the direction of arrow B in FIG. 4B. As shown in FIG. 4B, a through slot 140 is formed in the inner wall of the cavity 130, and an engaging surface 141 is formed at its upper end.

For the purpose of installing the cover 2 onto the scanner body 1, the distal ends of the parallel legs 220 together with the stopper 240 are directed to insert into the cavity 130 through the slot 110.

Figure 5A:
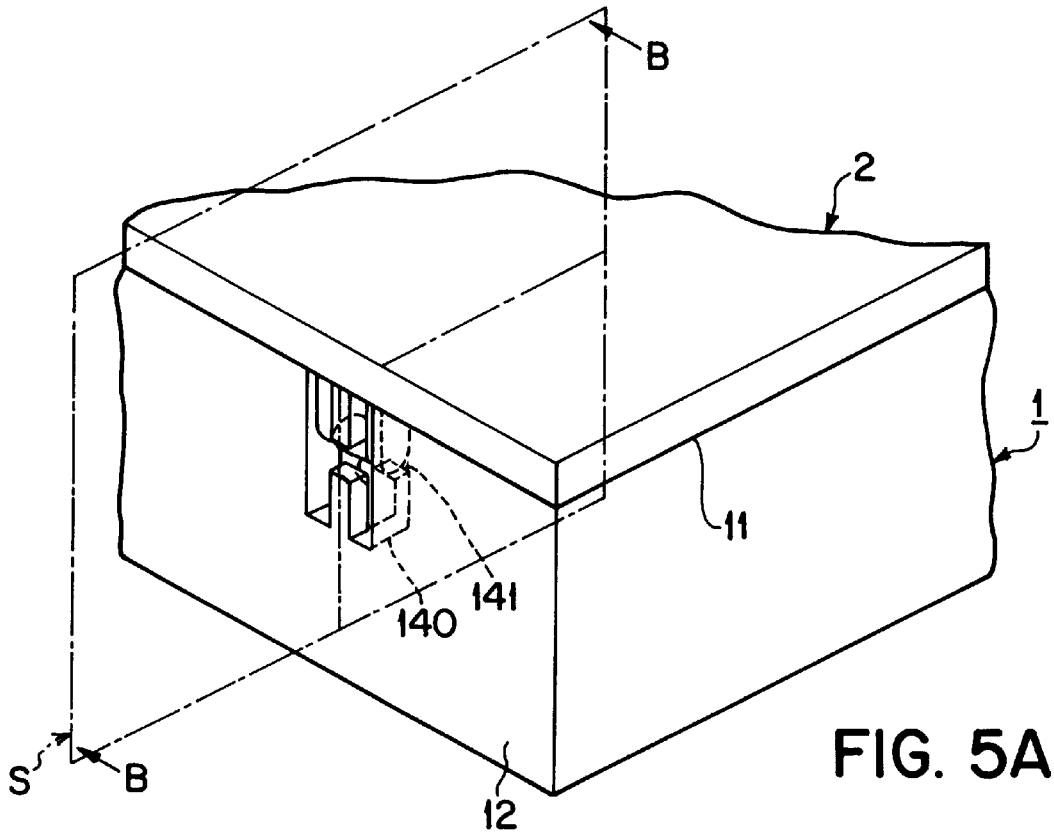
FIG. 5A is perspective view partially showing the cover fully placed on the top surface of the body with the coupling device according to FIG. 3.
Figure 5B:
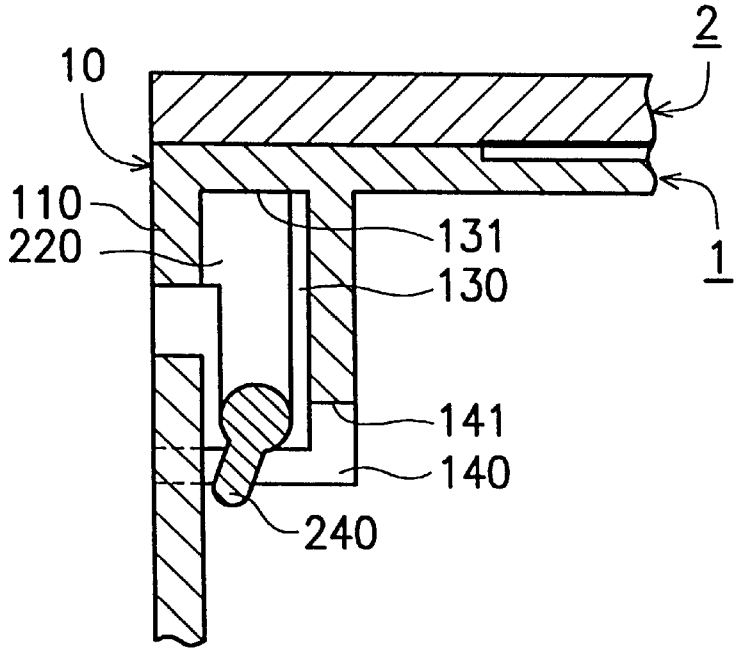
FIG. 5B is a cross-sectional view with the plan S inspected along the normal arrow B according to FIG. 5A

Referring to FIG. 5A and 5B, FIG. 5A is perspective view partially showing the cover 2 fully placed on the top surface 11 of the body 1, and FIG. 5B is a cross-sectional view along the plan S with the normal arrow B according to FIG. 5A.

As shown in FIG. 5A, the cover 2 is fully placed on the top surface 11 of the body, and the parallel legs 220 are rotated into a vertical attitude (see FIG. 5B).

Figure 6A:
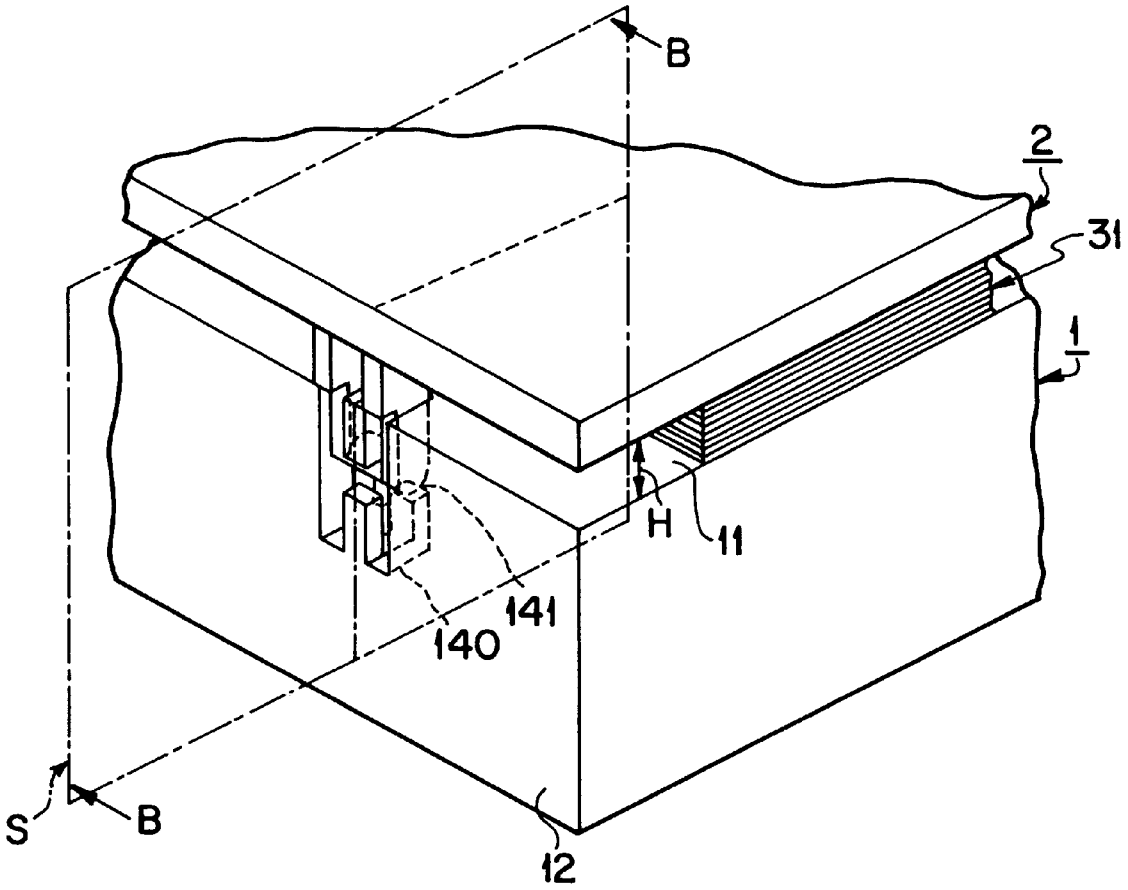
FIG. 6A is perspective view partially showing a thick document placed on the body with the cover hooding thereon.
Figure 6B:
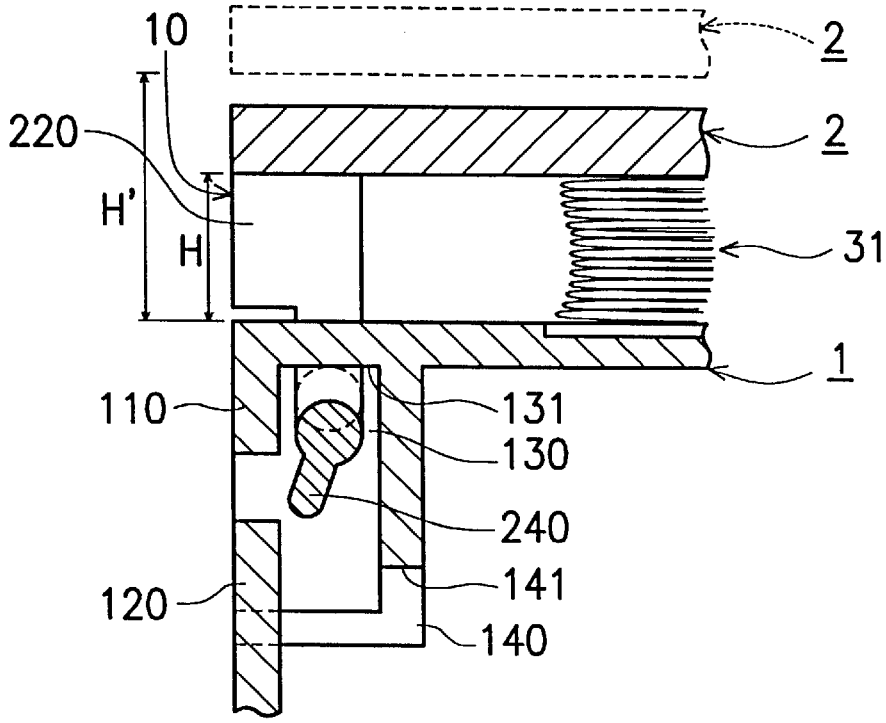
FIG. 6B is a cross-sectional view with the plan S inspected along direction of the normal arrow B of FIG. 6A.

Referring to FIG. 6, FIG. 6 is a perspective view partially showing a thick document 31 placed on the body 1 with the cover 2 hooding thereon. The document 31 with thickness H is placed on the top surface 11 of the scanner body 1 for scanning. Under this circumstance, the cover 2 is horizontally raised a distance of H'. However, when the cover 2 is raised further to a height of H', the stopper 240 will contact the inner upper wall 131 of the cavity 130. As a result, the cover 2 will be restrained from ascending further, and the cover 2 will not escape from the scanner body 1.

Figure 7:
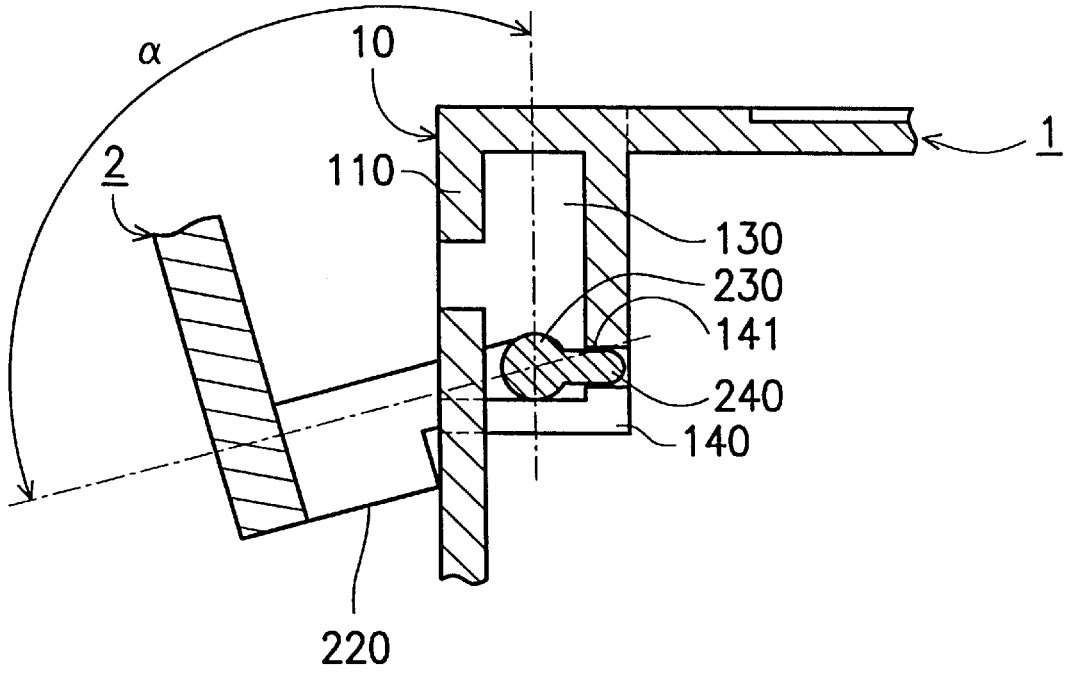
FIG. 7 is a cross-sectional view showing the stopper engaging with the engaging portion of the socket of the coupling device so as to retain the cover at an inclined angle according to FIG. 5B.

Referring to FIG. 7, FIG. 7 is a cross-sectional view showing the stopper 240 engaging with the engaging portion of the socket of the coupling device so as to retain the cover at an inclined angle according to FIG. 5B.

When the cover 2 is shifted from the horizontal attitude to an inclined attitude (see FIG. 7) by swiveling an angle α, the 240 formed on the pivoting shaft 230 stopper will contact the engaging surface 141 of the slot 140. By this arrangement, the cover 2 can be held at the inclined attitude without slumping down.

According to the structure of this invention, the cover can couple with the scanner body positively without disengaging.

Furthermore, the cover can be held at an inclined angle without slumping.

What is claimed is:

1. A platform housing comprising:

a cover having a coupling verge;

a platform body having a platform top surface and a platform sidewall;

a leg fixed to the coupling verge and having a distal end;

a pivot shaft formed at the distal end of the leg, wherein the pivot shaft is disposed normal to the leg;

a stopper coupled to the pivot shaft at a first predetermined angle;

a pivot socket formed at the intersection of the platform top surface and the platform sidewall, the pivot socket comprising a cavity, a vertical slot formed in the platform sidewall and extending to and penetrating the platform top surface for receiving the leg into the cavity, a horizontal slot formed in the platform sidewall for receiving the pivot shaft into the cavity, an upper engaging portion, and a lower engaging portion comprising a through slot formed in a lower surface of the cavity for receiving the stopper and an engaging surface formed at one end of the through slot, the stopper being free to swivel through the through slot until the stopper contacts the engaging surface, once the leg and pivot shaft are received into the cavity, the upper engaging portion, by contact with the pivot shaft, prevents the leg from escaping the cavity during vertical movement of the leg, and the engaging surface of the lower engaging portion, by contact with the stopper, prevents the opening of the cover beyond a second predetermined angle.

2. The platform housing claimed in claim 1, wherein the upper engaging portion comprises an upper surface of the cavity adjacent to vertical slot.

3. The platform housing as claimed in claim 1, wherein the pivot shaft and stopper are integrally formed.

4. The platform housing as claimed in claim 1, wherein the height of the horizontal gap is slightly larger than the diameter of the pivot shaft, and smaller than the combined length of the diameter of the pivot shaft and the stopper when the leg is in a vertical attitude, such that the pivot shaft and stopper cannot slip out of the horizontal gap during vertical movement of the leg.

5. A platform housing comprising:

a cover having a coupling verge;

a platform body having a platform top surface and a platform sidewall;

two legs fixed to the coupling verge and having distal ends;

a pivot shaft formed between the distal ends of the two legs, wherein the pivot shaft is disposed normal to the legs;

a stopper coupled to the pivot shaft at a first predetermined angle;

a pivot socket formed at the intersection of the platform top surface and the platform sidewall, the pivot socket comprising a cavity, two vertical slots formed in the platform sidewall and extending to and penetrating the platform top surface for respectively receiving the two legs into the cavity, a horizontal slot formed in the platform sidewall for receiving the pivot shaft into the cavity, an upper engaging portion, and a lower engaging portion comprising a through slot formed in a lower surface of the cavity for receiving the stopper and an engaging surface formed at one end of the through slots the stopper being free to swivel through the through slot until the stopper contacts the engaging surface; wherein, once the legs and pivot shaft are received into the cavity, the upper engaging portion, by contact with the pivot shaft, prevents the legs from escaping the cavity during vertical movement of the legs, and the engaging surface of the lower engaging portion, by contact with the stopper, prevents the opening of the cover beyond a second predetermined angle.

6. The platform housing claimed in claim 5, wherein the upper engaging portion comprises an upper surface of the cavity between the two vertical slots.

7. The platform housing as claimed in claim 5, wherein the pivot shaft and stopper are integrally formed.

8. The platform housing as claimed in claim 5, wherein the height of the horizontal gap is slightly larger than the diameter of the pivot shaft, and smaller than the combined length of the diameter of the pivot shaft and the stopper when the legs are in a vertical attitude, such that the pivot shaft and stopper cannot slip out of the horizontal gap during vertical movement of the legs.

9. A platform housing comprising:

a cover having a coupling verge;

a platform body having a platform top surface and a platform sidewall;

a leg fixed to the coupling verge and having a distil end;

a pivot shaft formed at the distal end of the leg, wherein the pivot shaft is disposed normal to the leg;

a stopper coupled to the pivot shaft at a first predetermined angle;

a pivot socket formed at the intersection of the platform top surface and the platform sidewall, the pivot socket comprising a cavity, a vertical slot formed in the platform sidewall and extending to and penetrating the platform top surface for receiving the leg into the cavity, a horizontal slot formed in the platform sidewall for receiving the pivot shaft into the cavity, an upper engaging portion; wherein, once the leg and pivot shaft are received into the cavity, the upper engaging portion, by contact with the pivot shaft, prevents the leg from escaping the cavity during vertical movement of the leg, and the height of the horizontal gap is slightly larger than the diameter of the pivot shaft, and smaller than the combined length of the diameter of the pivot shaft and the stopper when the leg is in a vertical attitude, such that the pivot shaft and stopper cannot slip out of the horizontal gap during vertical movement of the leg.

10. The platform housing claimed in claim 9, wherein the upper engaging portion comprises an upper surface of the cavity adjacent to vertical slot.

11. The platform housing claimed in claim 9, wherein the pivot socket further comprises a lower engaging portion, the lower engaging portion comprising a through slot formed in a lower surface of the cavity for receiving the stopper and an engaging surface formed at one end of the through slot, the stopper being free to swivel through the through slot until the stopper contacts the engaging surface.

12. The platform housing as claimed in claim 11, wherein the engaging surface, by contact with the stopper, prevents the opening of the cover beyond a second predetermined angle.

13. The platform housing as claimed in claim 9, wherein the pivot shaft and stopper are integrally formed.

14. A coupling assembly adapted for use with a cover and a platform body having a platform top surface and a platform sidewall, the coupling assembly comprising:

a leg adapted to attach to the cover and having a distal end;

a pivot shaft formed at the distal end of the leg, wherein the pivot shaft is disposed normal to the leg;

a stopper coupled to the pivot shaft at a first predetermined angle;

a pivot socket formed in the coupling assembly and provided at the intersection of the platform top surface and the platform sidewall, the pivot socket comprising a cavity, a vertical slot formed in a sidewall of the coupling assembly and arranged in the platform sidewall such that the vertical slot extends to and penetrates the platform top surface for receiving the leg into the cavity, a horizontal slot formed in the sidewall of the coupling assembly for receiving the pivot shaft into the cavity, an upper engaging portion, and a lower engaging portion comprising a through slot formed in a lower surface of the cavity for receiving the stopper and an engaging surface formed at one end of the through slot, the stopper being free to swivel through the through slot until the stopper contacts the engaging surface, wherein once the leg and pivot shaft are received into the cavity, the upper engaging portion, by contact with the pivot shaft, prevents the leg from escaping the cavity during vertical movement of the leg, and the height of the horizontal gap is slightly larger than the diameter of the pivot shaft, and smaller than the combined length of the diameter of the pivot shaft and the stopper when the leg is in i vertical attitude, such that the pivot shaft and stopper cannot slip out of the horizontal gap during vertical movement of the leg.

15. The coupling assembly as claimed in claim 14, wherein the upper engaging portion comprises an upper surface of the cavity adjacent to vertical slot.

16. The coupling assembly as claimed in claim 14, wherein the pivot socket further comprises a lower engaging portion, the lower engaging portion comprising a through slot formed in a lower surface of the cavity for receiving the stopper and an engaging surface formed at one end of the through slot, the stopper being free to swivel through the through slot until the stopper contacts the engaging surface.

17. The coupling assembly as claimed in claim 16, wherein the engaging surface, by contact with the stopper, prevents the opening of the cover beyond a second predetermined angle.

18. The coupling assembly as claimed in claim 14, wherein the pivot shaft and stopper are integrally formed.

* * * * *